United States Patent [19]

Kleber

[11] 4,309,510

[45] Jan. 5, 1982

[54] SIZING COMPOSITION

[75] Inventor: Rolf Kleber, Neu-Isenburg, Fed. Rep. of Germany

[73] Assignee: Hoechst Aktiengesellschaft, Fed. Rep. of Germany

[21] Appl. No.: 197,191

[22] Filed: Oct. 15, 1980

[30] Foreign Application Priority Data

Oct. 18, 1979 [DE] Fed. Rep. of Germany ..... 2942156

[51] Int. Cl.[3] ..... C08K 5/17

[52] U.S. Cl. ..... 525/6; 8/115.6; 252/8.8; 525/61

[58] Field of Search ..... 525/6, 61; 252/8.8; 8/115.6, DIG. 4

[56] References Cited

U.S. PATENT DOCUMENTS 3,345,346 10/1967 Reynolds ..... 525/61
3,386,982 6/1968 Gordon et al. ..... 525/6
4,014,800 3/1977 Kleber ..... 252/8.8

FOREIGN PATENT DOCUMENTS 2326966 12/1974 Fed. Rep. of Germany .

OTHER PUBLICATIONS

Encyclopedia of Chemical Technology, Kirk-Othmer, 3rd edition, vol. 2, pp. 264–266.

*Primary Examiner*—Paul R. Michl
*Attorney, Agent, or Firm*—Connolly and Hutz

[57] ABSTRACT

A sizing composition consisting of a polyvinyl alcohol and of from 1 to 30, preferably 5 to 15, weight %, referred to the polyvinyl alcohol, of an amine oxide of the formula

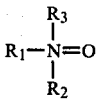

wherein $R_1$ is $C_5$–$C_{22}$alkyl, $R_2$ is $C_1$–$C_{22}$alkyl or a group of the formula—$(CH_2CH_2O)_nH$ with n being an integer of from 1 to 5 and $R_3$ is $C_1$–$C_5$alkyl or a group of the formula—$(CH_2CH_2O)_mH$ with m being an integer of from 1 to 10, if $R_2$ is alkyl having not more than 5 carbon atoms, the sum of n+m being not greater than 10.

2 Claims, No Drawings

SIZING COMPOSITION

Sizing of fibrous material with polyvinyl alcohol (PVAL) is well known in industry. In particular polyvinyl alcohols having a different saponfication degree, that is a different residual acetyl content, have proved appropriate in practice as sizing agent.

The use of polyvinyl alcohol for the sizing of filaments is, however, disputed in practice, since the sizing effect especially an hydrophobic filaments greatly varies in dependence on the polymerization degree of the polyvinyl alcohol used. The difficulties encountered when sizing hydrophobic filaments, for example polyesters, with polyvinyl alcohol as the sizing agent are described in "Polyvinylalkohole, pages 261 et seq." by Finch. The PVAL sizing film on these filaments is very brittle and may scale off during weaving thus possibly causing flaws on the textile material. The sizing effect can be improved according to Finch (loc.cit.) by adding plasticizing agents or by using acrylate sizing agents in admixture with polyvinyl alcohol.

However, upon addition of these agents the polyvinyl alcohol film may become sticky and tough. The admixed acrylate sizing agent, certainly, adheres very well to the polyester filament. A disadvantage is, however, that it is hygroscopic and that its cohesion and strength is far lower than that of polyvinyl alcohol. A further disadvantage resides in the fact that acrylate sizing agents applied to filaments are sensitive to spooling oils and spinning preparations.

It has now been found that sizes consisting of polyvinyl alcohol can be rendered flexible and soft by adding thereto an amine oxide and that they can thus be used successfully for sizing hydrophobic filaments.

Subject of the present invention therefore is a sizing composition consisting of a polyvinyl alcohol and of from 1 to 30, preferably 5 to 15, weight %, referred to the polyvinyl alcohol, of an amine oxide of the formula

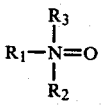

wherein $R_1$ is $C_5$–$C_{22}$alkyl, $R_2$ is $C_1$–$C_{22}$alkyl or a group of the formula —$(CH_2CH_2O)_nH$ with n being an integer of from 1 to 5 and $R_3$ is $C_1$–$C_5$alkyl or a group of the formula —$(CH_2CH_2O)_mH$ with m being an integer of from 1 to 10, if $R_2$ is alkyl having more than 5 carbon atoms, the sum of n+m being not greater than 10.

These amine oxides are known from German Pat. No. 2,326,966. They are derived from natural fatty acids, which are often mixtures of products of different length of the alkyl chains. These natural fatty acids can moreover contain varying quantities of unsaturated fatty acids. Thus mixtures of amine oxides with different length of the alkyl chains are also suitable for the present invention, these alkyl chains being optionally unsaturated. The amine oxides are compatible with the different types of polyvinyl alcohol and are added to the sizing liquor at the concentrations specified below. Generally the concentration of the claimed sizing agent in the sizing liquor ranges from 2 to 20 weight %. Further compounds such as emulsified fats, mineral oils, starch, starch ethers and so on may be added to the sizing liquor in addition to the polyvinyl alcohol and the amine oxide. The sizing composition according to the present invention is well suitable for sizing hydrophobic synthetic filaments, in particular polyester filaments.

Upon addition of the amine oxides there are obtained, after drying, clear sizing films of high flexibility. The amine oxides do not exude from the dried films and do not increase the hygroscopic property of the latter. They, however, improve the adhesive power of the PVAL sizes.

The present invention will be illustrated by the following examples.

EXAMPLE 1

A sizing composition is prepared consisting of:

(a) Polyvinyl alcohol, viscosity at 85° C. in a 10% solution: 5 cP (b) PVAL+2% of coconut dimethyl amine oxide (c) PVAL+5% of coconut dimethyl amine oxide (d) PVAL+20% of soyalkyldiglycol amine oxide.

Films were cast from the polyvinyl alcohol (a) or from the mixtures (b) to (d) and the films were tempered at 60° C. for 2 hours. Thereafter they were evaluated as follows:

| aspect | conditioned at relative humidity 65% | relative humidity 86% |
|---|---|---|
| (a) clear | solid | solid |
| (b) clear | flexible | flexible |
| (c) clear | flexible | flexible |
| (d) clear | very flexible | very flexible |

| | $H_2O$ absorption at relative humidity of 65% | relative humidity of 86% | Solubility of the film at 60° C. in water |
|---|---|---|---|
| a. | 7% | 17% | 30 sec. |
| b. | 7% | 17% | 30 sec. |
| c. | 7.1% | 17.3% | 30 sec. |
| d. | 7.5% | 18% | 28 sec. |

| | cohesion of the filaments after 8 days on PES | | |
|---|---|---|---|
| | 10 g/l | 20 g/l | resilience |
| a. | 4.5 cm | 9.5 cm | 20 |
| b. | 8.3 cm | 13.9 cm | 15 |
| c. | 9.8 cm | 14.0 cm | 12 |
| d. | 12 cm | 16.0 cm | 9 |

The cohesion of the filaments were determined according to Melliand Textilberichte 58 (1977), pages 187–194. The resilience was measured with a hardness tester, the above numbers indicating the number of oscillations, until a standstill of the pendulum is reached. By adding the amine oxide according to the invention, the flexibility of the sizing films is improved, whilst their water absorption hardly increases. The resilience which is a measure for the brittleness, is also reduced and the cohesion, which is a decisive feature for the adhesive power, is increased.

EXAMPLE 2

The following products are applied to a texturized polyester filament yarn (dtex 167 f 32) in a sizing machine:

(a) PVAL analogously to Example 1, (b) PVAL analogously to Example 1, but containing 10% of laurylhexaglycol amine oxide, (c) PVAL analogously to Example 1, but containing behenyl diethyl amine oxide (10%), (d) PVAL analogously to Example 1, but containing hexyl dibutyl amine oxide (10%).

The sizing liquor containing about 4% of the products (a) to (d) was applied to the yarn with a liquor take up of 200%. Upon drying at about 150° C. in cylinder drying machines, the warps contained about 8% of solids. During weaving warp (a) exhibited increased yarn breakage numbers, whilst warps (b) to (d) could be weaved in satisfactory manner.

What is claimed is:

1. A sizing composition consisting of a polyvinyl alcohol and of from 1 to 30, preferably 5 to 15, weight %, referred to the polyvinyl alcohol, of an amine oxide of the formula

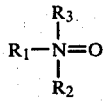

wherein $R_1$ is $C_5$–$C_{22}$alkyl, $R_2$ is $C_1$–$C_{22}$alkyl or a group of the formula $-(CH_2CH_2O)_nH$ with n being an integer of from 1 to 5 and $R_3$ is $C_{1-C5}$alkyl or a group of the formula $-(CH_2CH_2O)_mH$ with m being an integer of from 1 to 10, if $R_2$ is alkyl having not more than 5 carbon atoms, the sum of n+m being not greater than 10.

2. Sizing liquor containing of from 2 to 20 weight % of the sizing composition as claimed in claim 1.

* * * * *